US008395644B2

(12) United States Patent
Son et al.

(10) Patent No.: US 8,395,644 B2
(45) Date of Patent: Mar. 12, 2013

(54) LIQUID CRYSTAL DISPLAY AND DRIVING METHOD THEREOF

(75) Inventors: Hyeonho Son, Gyeonggi-do (KR); Gihong Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 655 days.

(21) Appl. No.: 12/314,778

(22) Filed: Dec. 16, 2008

(65) Prior Publication Data

US 2009/0303262 A1 Dec. 10, 2009

(30) Foreign Application Priority Data

Jun. 5, 2008 (KR) ..... 10-2008-0053375

(51) Int. Cl.
*G09G 5/10* (2006.01)

(52) U.S. Cl. ..... 345/690; 345/87; 345/88; 345/102; 345/204; 349/69; 362/231

(58) Field of Classification Search ..... 345/102, 345/690, 87–89, 91–94, 99, 204; 349/69; 362/231

See application file for complete search history.

(56) References Cited

U.S. PATENT DOCUMENTS

2004/0046725 A1* 3/2004 Lee ..... 345/88
2005/0134785 A1* 6/2005 Roth et al. ..... 349/144
2006/0232545 A1* 10/2006 Sekiguchi ..... 345/102
2007/0171670 A1* 7/2007 Zagar et al. ..... 362/601
2007/0182682 A1* 8/2007 Hong et al. ..... 345/88
2007/0230207 A1* 10/2007 Shin et al. ..... 362/561
2007/0236444 A1* 10/2007 Woo et al. ..... 345/102
2008/0094541 A1* 4/2008 Ma et al. ..... 349/69
2009/0160877 A1* 6/2009 Peng et al. ..... 345/690
2009/0167657 A1* 7/2009 Tomizawa ..... 345/88
2010/0182294 A1* 7/2010 Roshan et al. ..... 345/207

FOREIGN PATENT DOCUMENTS

KR 10-2007-0081001 A 8/2007
KR 10-2008-0023414 A 3/2008
WO WO2007/097080 * 8/2007

OTHER PUBLICATIONS

Roshan et.al. "Solid State Illumination System" PCT/JP2008/059956, GB 0711595.9 Jun. 15, 2007.*

* cited by examiner

*Primary Examiner* — Lun-Yi Lao
*Assistant Examiner* — Md Saiful A Siddiqui
(74) *Attorney, Agent, or Firm* — Morgan, Lewis & Bockius LLP

(57) ABSTRACT

The exemplary embodiment of the invention relates to a liquid crystal display device and a driving method thereof. The liquid crystal display device according to the exemplary embodiment of the invention comprises: a liquid crystal display panel wherein data lines and gate lines are disposed crosswisely each other; a controller modulating a first color input data and a second color input data with a first modulation width, and modulating a third color input data and a fourth color input data with a second modulation width higher than the first modulation width; a panel driving circuit supplying a first modulated color data, a second modulated data and a third modulated data to the liquid crystal display panel for a first period, and supplying the first modulated color data, the third modulated color data and a fourth modulated color data to the liquid crystal display panel for a second period; and a backlight device irradiating lights corresponding to the first, second and third modulated color data to the liquid crystal display panel for the first period, and irradiating lights corresponding to the first, third and fourth modulated color data to the liquid crystal display panel for the second period.

9 Claims, 7 Drawing Sheets

FIG. 7

| Gray | REF | | | ODC(RGBC) | | | ODC(GC) | | |
|---|---|---|---|---|---|---|---|---|---|
| | x | y | Y | x | y | Y | x | y | Y |
| 23 Gray | 0.3437 | 0.403 | 1.34 | 0.3228 | 0.3958 | 1.635 | 0.3008 | 0.4314 | 2.012 |
| 31 Gray | 0.3698 | 0.4508 | 2.729 | 0.4036 | 0.3949 | 2.503 | 0.3555 | 0.4511 | 3.573 |
| 39 Gray | 0.3779 | 0.4732 | 4.026 | 0.457 | 0.3791 | 3.058 | 0.3713 | 0.473 | 5.354 |
| 47 Gray | 0.3836 | 0.4864 | 5.71 | 0.4602 | 0.4046 | 4.534 | 0.3782 | 0.4882 | 7.623 |
| 55 Gray | 0.3876 | 0.4949 | 7.76 | 0.4395 | 0.4424 | 7.289 | 0.3888 | 0.4929 | 10.13 |
| 63 Gray | 0.3907 | 0.5017 | 10.16 | 0.4313 | 0.4604 | 10.23 | 0.3843 | 0.5038 | 13.81 |
| 71 Gray | 0.3917 | 0.5062 | 13.19 | 0.4304 | 0.4697 | 13.58 | 0.3823 | 0.5123 | 18.52 |
| 79 Gray | 0.3928 | 0.5098 | 16.97 | 0.4397 | 0.4678 | 16.79 | 0.3868 | 0.5143 | 23.48 |
| 87 Gray | 0.3935 | 0.5127 | 21.23 | 0.4445 | 0.4678 | 20.79 | 0.3869 | 0.5176 | 29.68 |
| 95 Gray | 0.393 | 0.5141 | 25.76 | 0.4389 | 0.4752 | 25.61 | 0.3828 | 0.5227 | 36.41 |
| 103 Gray | 0.3934 | 0.5167 | 30.76 | 0.4445 | 0.4735 | 29.89 | 0.3815 | 0.5252 | 44.14 |
| 111 Gray | 0.3931 | 0.5176 | 36.11 | 0.4448 | 0.4751 | 35.28 | 0.3776 | 0.5293 | 53.33 |
| 119 Gray | 0.3929 | 0.5189 | 41.54 | 0.4449 | 0.4764 | 40.75 | 0.3745 | 0.5332 | 63.01 |
| 127 Gray | 0.3927 | 0.5198 | 47.05 | 0.4406 | 0.4811 | 47.26 | 0.3728 | 0.5346 | 72.43 |
| 135 Gray | 0.3917 | 0.5207 | 53.67 | 0.4377 | 0.4839 | 54.96 | 0.3762 | 0.5329 | 81.46 |
| 143 Gray | 0.3923 | 0.521 | 61.88 | 0.4339 | 0.4877 | 64.07 | 0.379 | 0.5312 | 91.97 |
| 151 Gray | 0.3915 | 0.5225 | 70.29 | 0.4305 | 0.4911 | 73.23 | 0.3808 | 0.5303 | 102.2 |
| 159 Gray | 0.4003 | 0.5152 | 75.74 | 0.4316 | 0.4906 | 82.68 | 0.386 | 0.5269 | 113.1 |
| 167 Gray | 0.4001 | 0.5155 | 85.32 | 0.4293 | 0.4927 | 94.34 | 0.3889 | 0.5248 | 125.8 |
| 175 Gray | 0.4001 | 0.5161 | 95.54 | 0.4377 | 0.4863 | 101.2 | 0.3947 | 0.5209 | 136.9 |
| 183 Gray | 0.3902 | 0.5246 | 112.2 | 0.4375 | 0.4869 | 112.8 | 0.3981 | 0.5182 | 149.6 |
| 191 Gray | 0.3898 | 0.5249 | 123.1 | 0.4352 | 0.4888 | 126 | 0.3993 | 0.5176 | 164.5 |
| 199 Gray | 0.3895 | 0.5257 | 133 | 0.4313 | 0.4919 | 139.8 | 0.4053 | 0.5132 | 173.5 |
| 207 Gray | 0.3893 | 0.5259 | 144 | 0.4276 | 0.495 | 154.7 | 0.4162 | 0.505 | 177.4 |
| 215 Gray | 0.3886 | 0.5265 | 155.8 | 0.4297 | 0.4934 | 165 | 0.4266 | 0.4971 | 181.6 |
| 223 Gray | 0.3882 | 0.5269 | 168.3 | 0.4229 | 0.4969 | 183.8 | 0.4376 | 0.4892 | 185.9 |
| 231 Gray | 0.3875 | 0.5276 | 181.7 | 0.4109 | 0.5008 | 209.5 | 0.4352 | 0.4885 | 202.9 |
| 239 Gray | 0.3871 | 0.5282 | 196.3 | 0.4072 | 0.4999 | 230.2 | 0.4291 | 0.4886 | 225 |
| 247 Gray | 0.3867 | 0.5286 | 212.2 | 0.3744 | 0.4512 | 249.4 | 0.3928 | 0.4445 | 249.4 |
| 255 Gray | 0.386 | 0.5294 | 230.1 | 0.3584 | 0.4121 | 271.1 | 0.3702 | 0.4084 | 274.9 |

LIQUID CRYSTAL DISPLAY AND DRIVING METHOD THEREOF

This application claims the benefit of Korea Patent Application No. 10-2008-0053375 filed on Jun. 5, 2008, which is incorporated herein by reference for all purposes as if fully set forth herein.

BACKGROUND OF THE INVENTION

1. Field of the Invention

An exemplary embodiment of the invention relates to a liquid crystal display device and a driving method thereof.

2. Discussion of the Related Art

The active matrix type liquid crystal display (hereinafter, "AMLCD") device shows moving pictures or video data using the thin film transistor (hereinafter, "TFT") as the switching element. Comparing with the cathode ray tube (hereinafter "CRT") display device, the LCD device can have small and thin size and light weight. Therefore, it is rapidly applied to the portable communication & information devices, official automation appliances, computer monitor as well as TV monitor by replacing with the CRT.

The AMLCD device comprises a plurality of data lines and a plurality of gate lines crossed each other, and a plurality of liquid cells disposed in a region defined by the crossed data lines and gate lines. At each crossed area of data lines and gate lines, a TFT is formed.

Due to the development of the processing engineering and driving technology, the mass productivity of the LCD device is enhanced and the screen quality of the LCD device is improved more and more. However, the response characteristics of the liquid crystal material is not fast enough and the color representing characteristics of the LCD device is not fully satisfied for suggesting good video screen quality.

SUMMARY OF THE INVENTION

An exemplary embodiment of the invention provides an LCD device having advantages of improved response characteristics of the liquid crystal and enhanced color representing characteristics.

Additional features and advantages of the exemplary embodiments of the invention will be set forth in the description which follows, and in part will be apparent from the description, or may be learned by practice of the exemplary embodiments of the invention. The objectives and other advantages of the exemplary embodiments of the invention will be realized and attained by the structure particularly pointed out in the written description and claims hereof as well as the appended drawings.

In one aspect, a liquid crystal display device according to one embodiment of the exemplary embodiment of the invention comprises: a liquid crystal display panel wherein data lines and gate lines are disposed crossly each other; a controller modulating a first color input data and a second color input data with a first modulation width, and modulating a third color input data and a fourth color input data with a second modulation width higher than the first modulation width; a panel driving circuit supplying a first modulated color input data, a second modulated input data and a third modulated input data to the liquid crystal display panel for a first period, and supplying the first modulated color input data, the third modulated color input data and a fourth modulated color input data to the liquid crystal display panel for a second period; and a backlight device irradiating lights corresponding to the first, second and third modulated color input data to the liquid crystal display panel for the first period, and irradiating lights corresponding to the first, third and fourth modulated color input data to the liquid crystal display panel for the second period.

The first color input data is corresponding to the red color, the second color input data is corresponding to the green color, the third color input data is corresponding to the blue color, and the fourth color input data is corresponding to the cyan color.

Each of the first period and the second period includes a scanning period for charging the data to the liquid crystal display panel, a response delay period of liquid crystal, and a turn-on period for irradiating the light from the backlight device to the liquid crystal display panel.

The panel driving circuit comprises a data driving circuit converting the modulated first, second and third color input data to data voltages and supplying the data voltages to the data lines for the scanning period of the first period, and converting the modulated first, third and fourth color input data to data voltages and supplying the data voltages to the data lines for the scanning period of the second period; and a gate driving circuit supplying a gate pulse synchronized to the data voltages to the gate lines sequentially for the scanning periods of the first and second periods.

The backlight device includes a first LED (Light Emitting Diode) irradiating the first color; a second LED irradiating the second color; a third LED irradiating the third color; and a fourth LED irradiating the fourth color.

The LEDs are installed in a white LED module irradiating a white color light.

The liquid crystal display device further comprises an LED driving circuit turning on the first, second and third LEDs for the turn-on period of the first period; and turning on the first, third and fourth LEDs and turning off the second LED for the turn-on period of the second period.

In one aspect, a method for driving a liquid crystal display device according to the exemplary embodiment of the invention comprises of the steps of: modulating a first and a second color input data with a predetermined modulating depth, and modulating a third and a fourth color input data with a modulating depth higher than the predetermined modulating depth; supplying a first modulated, a second modulated and a third modulated color input data to the liquid crystal display panel for a first period, and supplying the first modulated, the third modulated and a fourth modulated color input data to the liquid crystal panel for a second period; and irradiating lights corresponding to the first, second and third modulated color input data to the liquid crystal display panel for the first period, and irradiating lights corresponding to the first, third and fourth modulated color input data to the liquid crystal display panel for the second period by controlling a backlight device.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 7 is the experiment result showing the improved effect in the chromaticity diagram of the liquid crystal display device according to the exemplary embodiment of the invention.

DETAILED DESCRIPTION OF THE ILLUSTRATED EMBODIMENTS

Reference will now be made in detail embodiments of the invention examples of which are illustrated in the accompanying drawings.

Referring to the FIGS. 1 to 7, preferred embodiments according to the exemplary embodiment of the invention will be described in detail.

Figure 1:
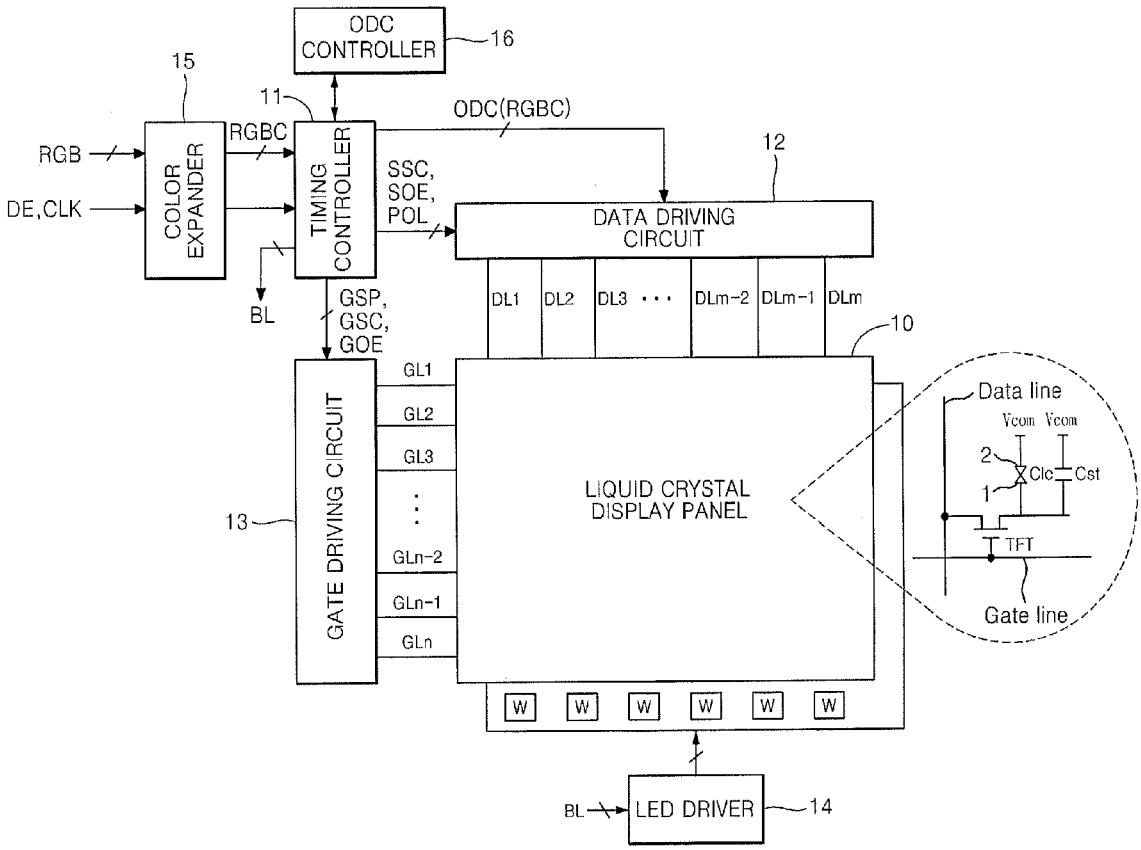
FIG. 1 is a block diagram showing a liquid crystal display device according to the exemplary embodiment of the invention.

Referring to the FIG. 1, the liquid crystal display device according to the exemplary embodiment of the invention comprises a liquid crystal display panel 10, a color expander 15, a timing controller 11, an over driving controller (or "ODD") 16, a data driving circuit 12, a gate driving circuit 13, and an LED driver 14.

The liquid crystal display panel 10 comprises two glass substrates facing each other and a liquid crystal layer formed between the two glass substrates. On the lower substrate of the liquid crystal display panel 10, data lines (DL1 to DLm) running along with column direction and gate lines (GL1 to GLn) running crosslikely to the data lines (DL1 to DLm) are formed. Each of the liquid cells (Clc) is located in the each of the pixel array disposed in a matrix array pattern formed by the crossed structure of the data lines (DL1 to DLm) and the gate lines (GL1 to GLn). Further, on the lower glass substrate, TFTs formed crossed points of the data lines (DL1 to DLm) and the gate lines (GL1 to GLn), pixel electrodes 1 of the liquid cell (Clc) connected to the TFT, and a storage capacitor (Cst) are formed. On the upper glass substrate of the liquid crystal display panel 10, a black matrix, color filter and a common electrode 2 are formed.

The common electrode 2 is formed on the upper glass substrate only for the vertical electric field driving type such as the TN (Twisted Nematic) mode and the VA (Vertical Alignment) mode. For the In-plan electric field driving type such as the IPS (In Plane Switching) mode and the FFS (Fringe Field Switching) mode, the common electrode 2 is formed on the lower glass substrate with the pixel electrode 1. On the each outer surface of the upper and lower glass substrates, polarizing plates are attached in which their light axes are perpendicularly crossed each other. On the each inner surface of the upper and lower glass substrate which contact with the liquid crystal material, alignment films are formed to orient the pre-tilting angle of the liquid crystal materials.

Under the liquid crystal display panel 10, a backlight assembly is disposed. The backlight assembly includes white LED modules (W), and various optical devices for irradiating lights from the white LED modules (W) to the liquid crystal display panel.

A color expander 15 generates the digital video data of the four primary colors (R, G, B and C) consisting of the red (R), green (G), blue (B) and cyan (C) colors after receiving the digital video data of three primary colors (R, G, and B) consisting of the red (R), green (G) and blue (B) colors. Applying the well-known calculation equation of cyan (C) color by using the R, G and B color data as parameters, the color expander 15 can generate the digital video data of cyan color. For example, the color expander 15 can generate the cyan color data using the method disclosed in "Color Conversion Method for Multiprimary Display Using Matrix Switching" invented by "Takeyuki AJITO et. al." and published on "OPTICAL REVIEW Vol. 8, No. 3 (2001) 191-197."

A timing controller 11 transmits the digital video data (RGBC) from the color expander 15 to an ODC controller 16 and supplies the modulated digital video data (OCD (RGBC)) from the ODC controller 16 to a data driving circuit 12. The timing controller 11 also receives timing signals such as data enable signal (DE signal) and the dot clock (CLK) and multiplies the timing signals in double speed. And then, the timing controller 11 generates a double speed data timing control signal for controlling the operating timing of the data driving circuit 12 and a double speed gate timing control signal for controlling the operating timing of the gate driving circuit 13 so that the liquid crystal display panel 10 can be driven with the 120 Hz frame frequency.

The double speed data timing control signal includes the source start pulse (SSP), the source sampling clock (SSC), the source output enable (SOE), and polarity (POL) signals. The source start pulse (SSP) indicates the start pixel in one horizontal line showing data. If the data transmission between the timing controller 11 and the data driving circuit 12 is the mini LVDS (low-voltage differential signaling) type, the mini LVDS clock is transmitted to the data driving circuit 12 with the digital video data (RGB). In this case in which the data is transmitted by the mini LVDS type, as the pulse of mini LVDS clock following the reset pulse plays role of the source start pulse, the timing controller 11 may not generate the source start pulse (SSP). The source sampling clock (SSC) signal controls the data latch operation in the data driving circuit 12 at rising or falling edge. The source output enable (SOE) signal controls the output of the data driving circuit 12. The logics of the polarity (POL) signal are alternated with the one or two horizontal period and they are alternated with one frame period.

The double speed gate timing control signals include the gate start pulse (GSP), the gate shift clock (GSC), and the gate output enable (GOE) signals. The gate start pulse (GSP) indicates the start line starting the scan during one vertical period showing one screen. The gate shift clock (GSC) signal is the clock signal for shifting the gate start pulse (GSP) sequentially after inputting into the shift register of the gate driving circuit 13. The gate output enable (GOE) signal controls the output of the gate driving circuit 13.

In addition, the timing controller 11 generates the backlight control (BL) signal to control the LED driving circuit 14.

The ODC controller 16 modulates the digital video data (RGBC) from the timing controller 11 using the modulated data registered in the Look-up Table stored in advance and generates the digital video data (ODC (RGBC)) for over driving control. For explaining the principle of the over driving control, like the Equations (1) and (2), the liquid crystal material has slow response speed due to the unique viscosity and elasticity.

$$\tau_r \propto \frac{\gamma d^2}{\Delta\varepsilon|V_a^2 - V_F^2|}. \quad (1)$$

Here, τr is the rising time at applying voltage to the liquid crystal layer, Va is the applied voltage, VF is the Frederick Transition Voltage at which the liquid crystal molecules start the tilting movement, d is the cell gap of the liquid crystal cell, and γ(gamma) is the rotational viscosity of liquid crystal molecule.

$$\tau_f \propto \frac{\gamma d^2}{K} \quad (2)$$

Here, τf is the falling time when the liquid crystal molecule returns to original position by the elastic restoring force after turning off the voltage applied to the liquid crystal molecule, K is the natural elasticity coefficient of liquid crystal molecule.

In the over driving control, the $|V_a^2-V_F^2|$ of the Equation 1 is changed by the method in the Equations 3 to 5 based on the changes of the data to get desired luminescence corresponding to the luminescence of the input data during one frame period. Therefore, the modulation data registered in the Look-up Table of the ODC controller 16 satisfies the Equations (3) to (5).

$$Fn(RGBC)<Fn-1(RGBC)\rightarrow ODC(RGBC)<Fn(RGBC) \quad (3)$$

$$Fn(RGBC)=Fn-1(RGBC)\rightarrow ODC(RGBC)=Fn(RGBC) \quad (4)$$

$$Fn(RGBC)>Fn-1(RGBC)\rightarrow ODC(RGBC)>Fn(RGBC) \quad (5)$$

The modulation data registered in the Look-up Table of the OCD controller 16 are set so as they have larger values than those of the current frame (Fn) when the data supplied to the same pixel are higher then those of the previous frame (Fn−1). If the values of current frame (Fn) are lower than those of the previous frame (Fn−1), the modulation data registered in the Look-up Table are set so as they have smaller values than those of the current frame (Fn). The modulation data registered in the Look-up Table of the OCD controller 16 are set to the same values with those of the current frame (Fn) when the data value applied to the same pixel are the same between the previous frame (Fn−1) and the current frame (Fn). The ODC controller 16 may be applied with the modulation methods disclosed in the Korean Patent applications 10-2001-0032364, 10-2001-0057119, 10-2001-0054123, 10-2001-0054124, 10-2001-0054125, 10-2001-0054127, 10-2001-0054128, 10-2001-0054327, 10-2001-0054889, 10-2001-0056235, 10-2001-0078449, 10-2002-0046858, and 10-2002-0074366. Especially, as mentioned bellow, the ODC controller 16 according to the exemplary embodiment of the invention controls the modulation widths for G and C with larger values than the modulation widths for R and B in order to compensate the distortion of yellow color caused by that the turn-on timing-of the blue and cyan lights is shorter than the turn-on timing of the red and green.

The data driving circuit 12 latches the digital video data (ODC(RGBC)) under the controlling of the timing controller 11 and modulates the digital video data (ODC(RGBC)) with the positive/negative gamma compensation voltages to generate the positive/negative data voltages. The data voltages are supplied to the data lines (DL1 to DLm).

Figure 2:
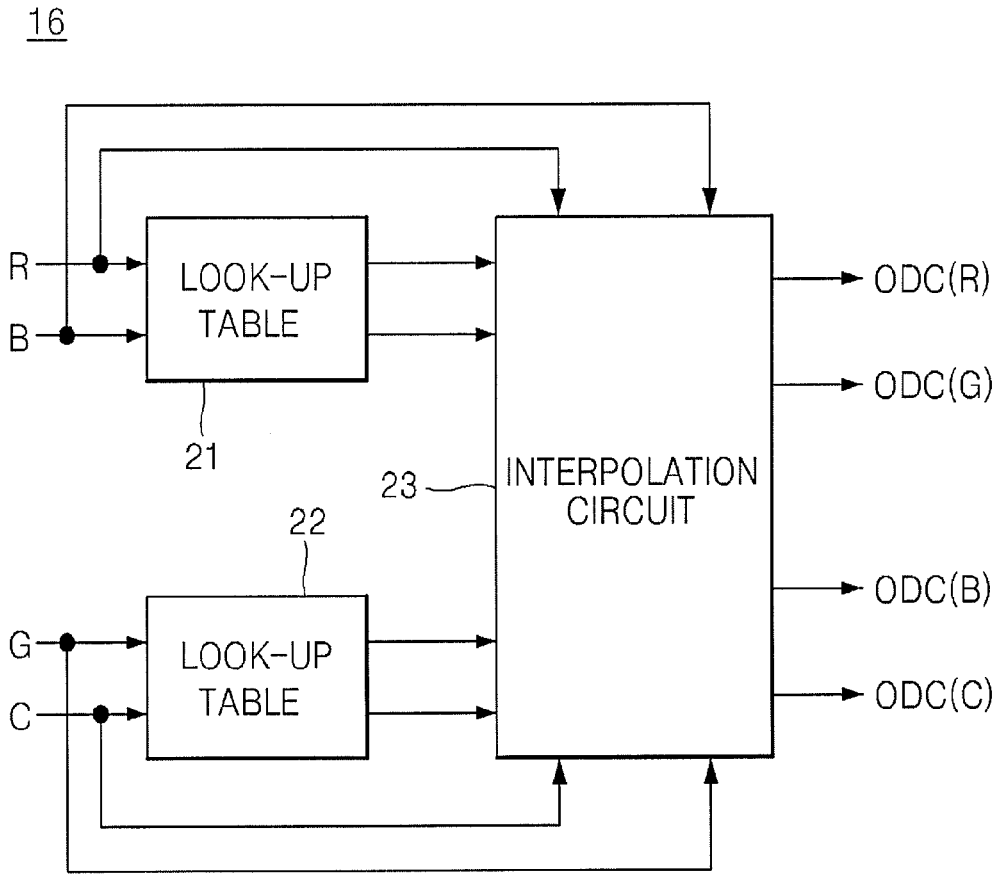
FIG. 2 is a block diagram showing the ODC controller in the FIG. 1 in detail.

The gate driving circuit 13 includes a shift register, a level shifter for modulating the output signal of the shift register with the swing depth (width) proper to drive the TFT of the liquid crystal cell, and an output buffer. The gate driving circuit 13 supplies the gate pulse to the gate lines (GL1 to GLn) sequentially. FIG. 2 shows the ODC controller 16 in detail.

Referring to the FIG. 2, the ODC controller 16 includes the Lock-up Tables 21 and 22, and an interpolation circuit 23.

The Look-up tables 21 and 22 include a first Look-up Table 21 registering modulating data for R and B digital video data and a second Look-up Table 22 registering modulating data for G and C digital video. The first Look-up table 21 selects R and B modulating data satisfying the Equations 3 to 5 using the R and B digital video data of the previous frame stored in the frame memory (not shown) after received at the previous frame period and the R and B digital video data of the current frame as the addresses. The second Look-up table 22 selects G and C modulating data satisfying the Equations 3 to 5 using the G and C digital video data of the previous frame stored in the frame memory (not shown) after received at the previous frame period and the G and C digital video data of the current frame as the addresses. The modulation width (width) of the G and C modulation data registered in the second Look-up table 22 satisfies the Equations 3 to 5 and should be set as they have higher modulation width than those of the R and B modulation data registered in the first Look-up table 21.

For an example of the first Look-up table 21, the look-up table for modulating R data may be as shown in following Table 1. Referring to the Table 1, the modulation width of the G and C modulation data and the modulation width of the R and B modulation data can be explained as follows.

TABLE 1

| | 0 | 32 | 64 | 96 | 128 | 160 | 192 | 208 | 224 | 240 | 248 | 255 |
|---|---|---|---|---|---|---|---|---|---|---|---|---|
| 0 | 0 | 36 | 76 | 113 | 152 | 184 | 214 | 225 | 238 | 249 | 253 | 255 |
| 32 | 0 | 32 | 72 | 110 | 149 | 182 | 212 | 224 | 237 | 247 | 253 | 255 |
| 64 | 0 | 28 | 64 | 104 | 143 | 177 | 209 | 222 | 235 | 246 | 252 | 255 |
| 96 | 0 | 27 | 60 | 96 | 136 | 172 | 205 | 220 | 233 | 245 | 252 | 255 |
| 128 | 0 | 27 | 56 | 89 | 128 | 166 | 201 | 216 | 231 | 243 | 251 | 255 |
| 160 | 0 | 27 | 53 | 83 | 121 | 160 | 197 | 213 | 229 | 242 | 251 | 255 |
| 192 | 0 | 27 | 51 | 77 | 114 | 153 | 192 | 210 | 227 | 241 | 250 | 255 |
| 208 | 0 | 27 | 50 | 73 | 111 | 149 | 189 | 208 | 225 | 241 | 250 | 255 |
| 224 | 0 | 27 | 48 | 70 | 106 | 145 | 186 | 205 | 224 | 240 | 249 | 255 |
| 240 | 0 | 27 | 46 | 69 | 104 | 143 | 185 | 204 | 223 | 240 | 249 | 255 |
| 248 | 0 | 27 | 45 | 68 | 103 | 142 | 184 | 203 | 223 | 239 | 248 | 255 |
| 255 | 0 | 27 | 44 | 67 | 102 | 141 | 183 | 203 | 222 | 239 | 247 | 255 |

In the Table 1, the most left column has the R digital video data of the previous frame and the most upper row has the R digital video data of the current frame.

For instance, if the R digital video data of the previous frame is "128" and the R digital video data of the current frame is "160," the first Look-up Table 21 selects "166" satisfying the Equation 3 in the R modulation data of the Table 1. In this case, the modulation width of the R data is "|160−166|=6". The modulation width of the B data would be set in same or similar with the modulation width of the R data. On the contrary, if the G digital video data of the previous frame is "128" and the G digital video data of the current frame is "160", the second Look-up table 22 selects "168" satisfying the Equation 3 in the G modulation data. In this case, the modulation width of the G data is "|160−168|=8" so that it is higher than modulation width of the R and B data. Similarly; the modulation data for C data is set such as that the modulation width of the C data is higher than the modulation width of the R and B data.

When the R digital video data of the previous frame is "128" and the R digital video data of the current frame is "96", the first Look-up table 21 selects "89" satisfying the Equation 5 in the R modulation data of the Table 1. In this case, the modulation width of the R data is "|96−89|=7". The modulation width of the B data would be set in same or similar with the modulation width of the R data. On the contrary, if the G digital video data of the previous frame is "128" and the G digital video data of the current frame is "96", the second Look-up table 22 selects "87" satisfying the Equation 5 in the G modulation data. In this case, the modulation width of the G data is "|96−87|=9" so that it is higher than modulation width of the R and B data. Similarly, the modulation data for C data is set such as that the modulation width of the C data is higher than the modulation width of the R and B data.

For reducing the capacity of the memory, the first and second Look-up tales 21 and 22 may selects the modulating data using the upper bits of the digital video data as addresses, and the modulation data may be set by the upper bits. Therefore, the modulated data by the Look-up tables 21 and 22 does not have to be all gray scales. Rather, they may be the gray scale data which can be the data of a portion of gray scale represented by upper bits. The data of gray scale not modulated by the Look-up tables 21 and 22 can be modulated by the linear approximation method treated by the interpolation circuit 23.

The interpolation circuit 23 receives the un-modulated gray scale data existing in the modulated data by the Look-up tables 21 and 22, and approximately modulates the un-modulated gray scale data by the linear approximation method using the un-modulated data and the modulated data by the Look-up tables 21 and 22 as variables. For example, using the approximation method, the interpolation circuit 23 generates the modulation data satisfying the Equations 3 to 5 for 1~31, 33~63, 65~95, 97~127 and 129~159 the un-modulated data by the Table 1. An example of the linear approximation method for the interpolation circuit 23 according to the exemplary embodiment of the invention is explained in KR 10-2004-0049638 and KR 10-2004-0049638 filed by the applicant of this invention.

Figure 3:
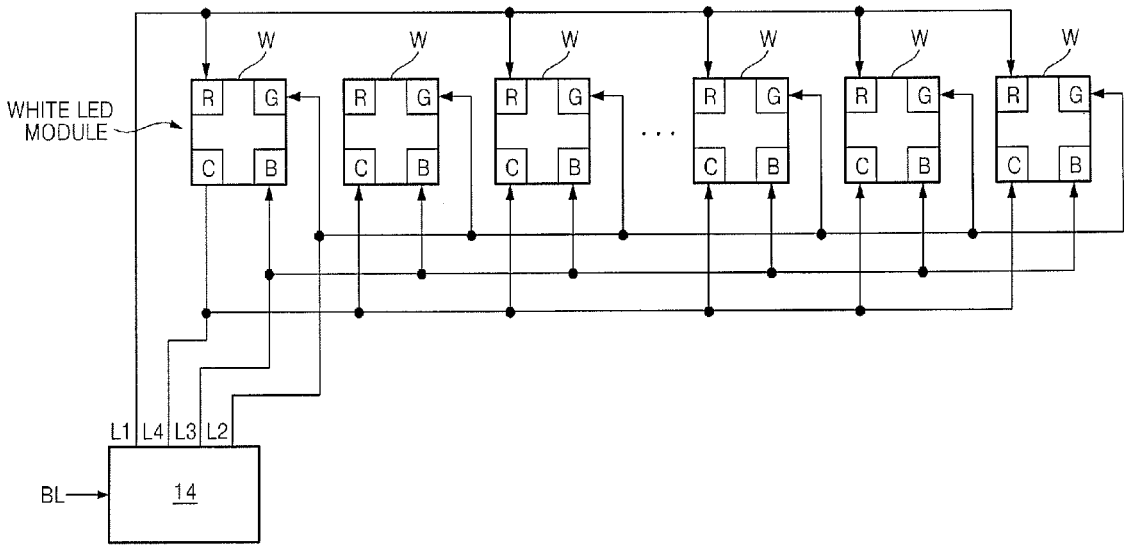
FIG. 3 is a circuit diagram showing the connecting relationship between the LED driving circuit and the white LED module in the FIG. 1 in detail.
Figure 4:
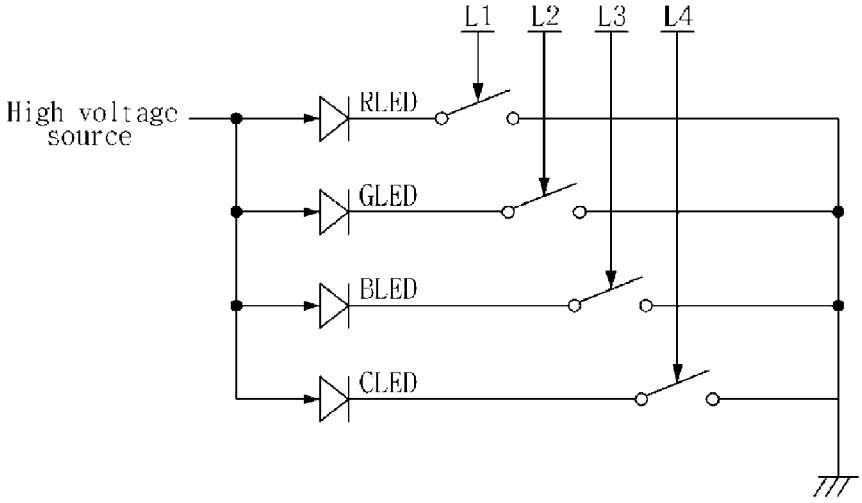
FIG. 4 is an equivalent circuit diagram showing one white LED module (W).

FIG. 3 is the circuit diagram showing the connections between the LED driving circuit 14 and the white LED modules (W) in detail. FIG. 4 is the equivalent circuit diagram of the white LED module (W).

Referring to the FIGS. 3 and 4, each of the white LED modules (W) comprise an RLED emitting red light, a GLED emitting green light, a BLED emitting blue light, a CLED emitting cyan light, and switch elements for switching current path of each LED. The anode electrode of each LED is connected to the high voltage source, and the cathode electrode is connected to one node of the switch element. Each switch element is connected between the cathode electrode of LED and the ground voltage (GND) so that it responses to the LED turn-on signal applied to its control terminal and forms the current path between LED and the ground voltage (GND). Therefore, when each switch element turns on, the current is flowing through each LED so that each LED can emit its light.

The LED driving circuit 14 generates a first, a second, a third and a fourth LED turn-on signal (L1 to L4) under the control of the timing controller 11 to turn on or off each LED included in the white LED modules (W). The first LED turn-on signal (L1) is applied to the control terminal of the first switch element connected between the RLED and the ground (GND) to turn on or off the RLED. The second LED turn-on signal (L2) is applied to the control terminal of the second switch element connected between the GLED and the ground (GND) to turn on or off the GLED. The third LED turn-on signal (L3) is applied to the control terminal of the third switch element connected between the BLED and the ground (GND) to turn on or off the BLED. The fourth LED turn-on signal (L4) is applied to the control terminal of the fourth switch element connected between the CLED and the ground (GND) to turn on or off the CLED.

Figure 5:
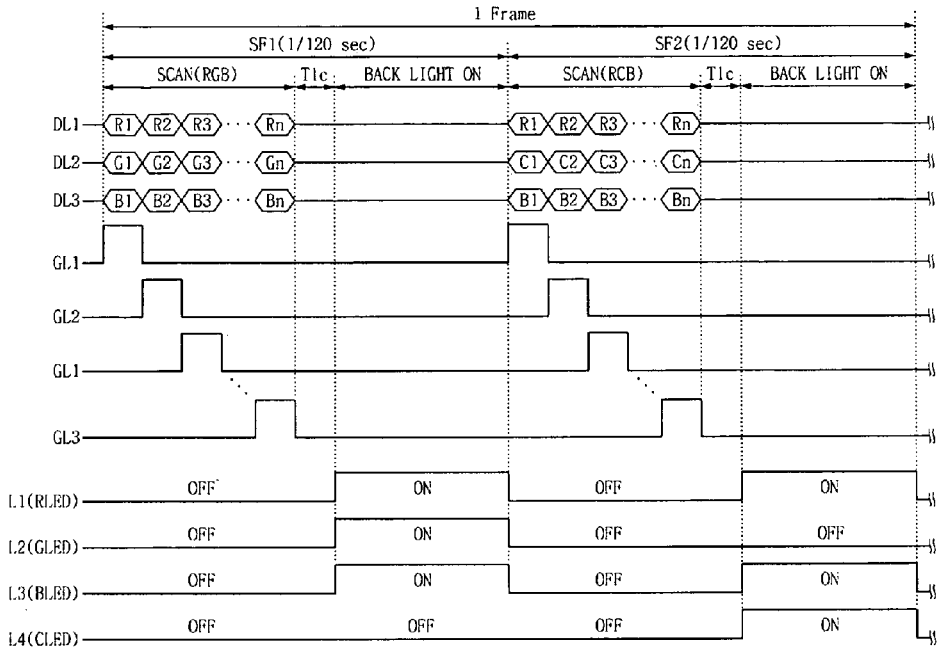
FIG. 5 is a waveform diagram of the driving signal of the liquid crystal display device in the FIG. 1.

FIG. 5 is a waveform diagram explaining the driving method of the liquid crystal display device according to the embodiment of the exemplary embodiment of the invention.

Referring to the FIG. 5, the liquid crystal display device according to the exemplary embodiment of the invention is driven with the 120 Hz frame frequency and one frame period is divided into a first sub frame period (SF1) and a second sub frame period (SF2).

Each of the first and second sub frame periods (SF1 and SF2) comprises a scanning period (SCAN) charging the data voltage to the liquid crystal cells line by line sequentially, a response delay time of liquid crystal (Tlc), and a backlight-on period.

During the scanning period (SCAN(RGB)) of the first sub frame period (SF1), the data lines (DL1 to DLm) are supplied with the R data voltage, G data voltage and B data voltage from the data driving circuit 12, and the gate lines (GL1 to GLn) are sequentially supplied with the gate pulse synchronizing with the data voltage. After the data voltages are charged to all liquid crystal cells of the panel and then the response delay period of the liquid crystal (Tlc) is passed, the white LED modules (W) of the backlight assembly are turning on. During the backlight-on period of the first sub frame period (SF1), electric currents are flowing to the RLED, GLED and BLED of the white LED modules (W) so that they turns on, while the CLED of the white LED modules (W) is maintained in turn-off state.

During the scanning period (SCAN(RGB)) of the second sub frame period (SF2), the data lines (DL1 to DLm) are supplied with the. R data voltage, C data voltage and B data voltage from the data driving circuit 12, and the gate lines (GL1 to GLn) are sequentially supplied with the gate pulse synchronizing with the data voltage. After the data voltages are charged to all liquid crystal cells of the panel and then the response delay period of the liquid crystal (Tlc) is passed, the white LED modules (W) of the backlight assembly are turning on. During the backlight-on period of the second sub frame period (SF2), electric currents are flowing to the RLED, CLED and BLED of the white LED modules (W) so that they turns on, while the GLED of the white LED modules (W) is maintained in turn-off state.

The data driving circuit 12 modulates the R, G and B digital video data (ODC(RGB) modulated during the scanning period (SCAN(RGB)) of the first sub frame period under the control of the timing controller 11 into the positive/negative data voltage and then supplies them to the data lines (DL1 to DLm). Further, the data driving circuit 12 modulates the R, C and B digital video data (ODC(RCB) modulated during the scanning period (SCAN(RCB)) of the second sub frame period under the control of the timing controller 11 into the positive/negative data voltage and then supplies them to the data lines (DL1 to DLm).

The gate driving circuit 13, under the control of the timing controller 11, sequentially supplies the gate pulse synchronizing with the data voltage to the gate lines (GL1 to GLn) during the scanning period (SCAN(RGB) and SCAN(RCB)) of the first and the second sub frame periods (SF1 and SF2).

Figure 6:
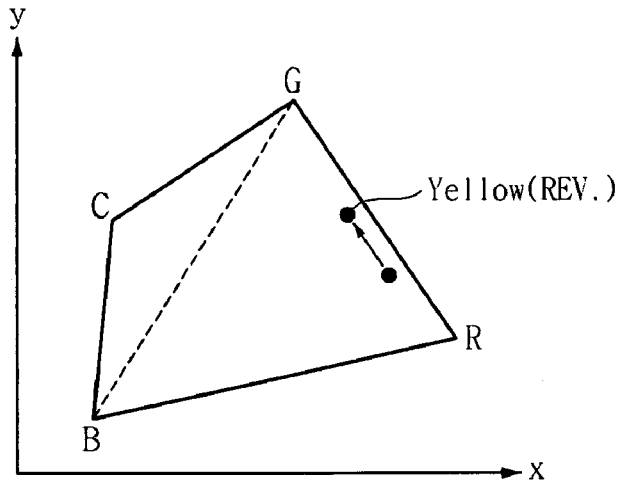
FIG. 6 is a chromaticity diagram of the liquid crystal display device according to the exemplary embodiment of the invention.

When the liquid crystal display device is operated by the above mentioned method, as shown in FIG. 6, it shows color picture with the four primary colors of R, G, B and C. Therefore, the color representing range can be enlarged so it is possible to show more natural color picture than the liquid crystal display device using the three primary colors.

For improving the response characteristics of the liquid crystal material, if the R, G, B and C data is modulated with the same modulation width, then the yellow color may not be represented correctly. In detail, the yellow color light is generated by mixing the red color light and the green color light. As shown in FIG. 5, the RLED is continually turning on during the first and second sub frame period (SF1 and SF2), while the GLED turns on for the first sub frame period (SF1), and turns off for the second sub frame period (SF2). As a result, the yellow color light has the step response so that real yellow can not be represented. It rather looks like a reddish yellow color. Further, due to the step response, the cyan color light can not be fully represented with natural color.

The liquid crystal display device according to the exemplary embodiment of the invention has a higher data modulation width for overdrive of the G and C of which turning-on times are short than the data modulation width for overdrive of the R and B of which turning-on times are long. Therefore, the liquid crystal display device according to the exemplary embodiment of the invention can represent the real yellow light with the reference point of yellow in the FIG. 6.

The FIG. 7 shows the result of experience in which the overdrive data modulation width of G and C is higher than the overdrive data modulation width of R and B.

In FIG. 7, the "REF." is the reference value for ideal color coordinate (x, y) and luminescence (Y) in each gray scale, and the "ODC (RGBC))" is the ideal reference value of color coordinate (x, y) and luminescence (Y) when the R, G, B and C data is modulated with the same modulation width using the same Look-up table. In addition, the "ODC (GC))" is the reference value for the color coordinate (x, y) and luminescence (Y) when the R and B data are modulated with the Look-up table data of "ODC (RGBC))" and the G and C data are modulated with the modulation data having higher modulation width than the Look-up table data of "ODC (RGBC))".

At "127" gray scale, the reference value of color coordinate (x, y) is "0.3927" for x value and "0.5198" for y value. For the result from that the overdrive modulation widths of R, G, B and C are same, the x is measured with "0.4406" and the y is measured with "0.4811" for the color coordinate (x, y) of "127" gray scale so that the measured values are different from the reference values somewhat largely. At this time, the color coordinate is an approximated point to R in FIG. 6.

On the contrary, for the result from that the overdrive modulation widths of G and C data is higher than the overdrive modulation widths of R and B data, the x is measured with "0.3728" and the y is measured with "0.5348" for the color coordinate (x, y) of "127" gray scale so that the measured values are approached to the reference value. At this time, the color coordinate is the approximated point to the Yellow (REF.) in the FIG. 6.

As set forth above, the liquid crystal display device according to the exemplary embodiment of the invention has an effective improved response characteristics of the liquid crystal using overdriving method for data modulation as well as an effective widen color representing range by the four primary color driving and the controlling in which the overdrive modulation widths for G and C are higher than those of R and B. It can show picture and video data with color closer to the natural color.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A liquid crystal display device comprising:

a liquid crystal display panel on which data lines and gate lines are disposed crosswisely each other, wherein one frame of the liquid crystal display panel is divided into a first sub frame period and a second sub frame period;

a controller for modulating a first color input data and a third color input data with a gray scale value of a first modulation width, and for modulating a second color input data and a fourth color input data with a gray scale value of a second modulation width higher than the first modulation width;

a panel driving circuit for supplying a first modulated color input data, a second modulated color input data and a third modulated color input data to the liquid crystal display panel for the first sub frame period, and for supplying the first modulated color input data, the third modulated color input data and a fourth modulated color input data to the liquid crystal display panel for the second sub frame period; and a backlight device irradiating a first color light, a second color light and a third color light corresponding to the first, second and third modulated color input data to the liquid crystal display panel for the first sub frame period, and irradiating the first color light, the third color light and a forth color light corresponding to the first, third and fourth modulated color input data to the liquid crystal display panel for the second sub frame period, wherein the first modulated color input data, the second modulated color input data, the third modulated color input data and the fourth modulated color input data are each of different modulated color input data of red, green, blue and cyan color.

2. The device according to the claim 1, wherein the first color data is red, the second color data is green, the third color data is blue and the fourth color data is cyan.

3. The device according to the claim 1, wherein the first and second sub frame period include a scanning period in which data voltages are charged to the liquid crystal display panel, a response delay period of the liquid crystal, and a turn-on period in which lights are irradiated to the liquid crystal display panel;

wherein the panel driving circuit comprises:

a data driving circuit for converting the first modulated color input data, the second modulated color input data and the third modulated color input data to the data voltages and supplying them to the data lines during the scanning period of the first sub frame period, and for converting the first modulated color input data, the third modulated color input data and the fourth modulated color input data to the data voltages and supplying them to the data lines during the scanning period of the second sub frame period; and a gate driving circuit for supplying a gate pulse synchronized with the data voltage to the gate lines sequentially during the scanning periods of the first and second sub frame period.

4. The device according to the claim 3, wherein the backlight device comprises:

a first LED emitting the first color light;

a second LED emitting the second color light;

a third LED emitting the third color light; and a fourth LED emitting the fourth color light, wherein the first, second, third and fourth LEDs are embedded into a white LED module.

5. The device according to the claim 4, further comprising an LED driving circuit for turning on the first, second and third LEDs during the turn-on period of the first sub frame period, and for turning on the first, third and fourth LEDs and turning off the second LED during the turn-on period of the second sub frame period.

6. A method for driving a liquid crystal display device including a liquid crystal display panel on which data lines and gate lines are disposed crosswisely each other, and a backlight unit irradiating lights to the liquid crystal display panel, comprising:

modulating a first color input data and a second color input data with a gray scale value of a first modulation width and modulating a third color input data and a fourth color input data with a gray scale value of a second modulation width higher than the first modulation width;

supplying a first modulated color input data, a second modulated color input data and a third modulated input color data to the liquid crystal display panel during a first sub frame period, and supplying the first modulated color input data, the third modulated color input data and a fourth modulated color input data to the liquid crystal display panel during a second sub frame period; and irradiating a first color light, a second color light and a third color light corresponding to the first, second and third modulated color input data to the liquid crystal display panel during the first sub frame period, and irradiating the first color light, the third color light and a forth color light corresponding to the first, third and fourth modulated color input data to the liquid crystal display panel during the second sub frame period, wherein the first modulated color input data, the second modulated color input data, the third modulated color input data and the fourth modulated color input data are each of different modulated color input data of red, green, blue and cyan color.

7. The method according to the claim 6, wherein the first color data is red, the second color data is green, the third color data is blue and the fourth color data is cyan.

8. The method according to the claim 6, wherein the first and second sub frame period include a scanning period in which data voltages are charged to the liquid crystal display panel, a response delay period of the liquid crystal, and a turn-on period in which the lights are irradiated to the liquid crystal display panel.

9. The method according to the claim 8, wherein the irradiating lights corresponding to the first, second and third color data to the liquid crystal display panel during the first sub frame period, and irradiating lights corresponding to the first, third and fourth color data to the liquid crystal display panel during the second sub frame period comprises:

turning on light sources emitting the first, second and third colors in the backlight device during the turn-on period of the first sub frame period; and turning on light sources emitting the first, third and fourth colors and turning off the light source emitting the second color in the backlight device during the turn-on period of the second sub frame period.

* * * * *